US006557283B1

(12) United States Patent
Canfield

(10) Patent No.: US 6,557,283 B1
(45) Date of Patent: May 6, 2003

(54) BACK-LIGHTING ARRANGEMENT FOR ILLUMINATED SIGNS

(76) Inventor: Mark Canfield, 617 Zanmiller Dr., Northfield, MN (US) 55057

( * ) Notice: Subject to any disclaimer, the term of this patent is extended or adjusted under 35 U.S.C. 154(b) by 0 days.

(21) Appl. No.: 09/978,886

(22) Filed: Oct. 16, 2001

(51) Int. Cl.[7] ..... B09F 13/04
(52) U.S. Cl. ..... 40/564; 40/545
(58) Field of Search ..... 40/564, 545, 575, 40/576, 570, 580

(56) References Cited

U.S. PATENT DOCUMENTS

| | | | | |
|---|---|---|---|---|
| 1,129,632 A | * | 2/1915 | Brown | 40/580 |
| 4,272,901 A | | 6/1981 | Matthews | |
| 5,003,443 A | | 3/1991 | Sabala | |
| 5,832,642 A | | 11/1998 | Dalton | |
| 5,833,558 A | | 11/1998 | Pettle | |
| 6,024,476 A | | 2/2000 | Wakeman | |

FOREIGN PATENT DOCUMENTS

| | | | | |
|---|---|---|---|---|
| AU | 151542 | * | 1/1951 | 40/580 |
| CH | 142006 | * | 8/1930 | 40/580 |
| GB | 342814 | * | 2/1931 | 40/580 |

* cited by examiner

*Primary Examiner*—Cassandra H. Davis
(74) *Attorney, Agent, or Firm*—Haugen Law Firm PLLP

(57) ABSTRACT

An illuminated sign assembly having opaque indicia arranged on a translucent back-lighted panel, the assembly comprising an opaque frame consisting of an elongated rectangular enclosure with four walls, a bottom enclosure and an open top. The back-lighted panel extends across the open top of the enclosure, with the outer surface of the translucent panel being secured in place by a frame means having an inwardly extending opaque surface which masks the illuminating means from the translucent panel so as to indirectly illuminate the panel.

2 Claims, 4 Drawing Sheets

10
12
16
26
27
26
13
15
19
35
24
17
11
21
22
20
18
23
15
23

BACK-LIGHTING ARRANGEMENT FOR ILLUMINATED SIGNS

BACKGROUND OF THE INVENTION

The present invention relates generally to an improved sign assembly, and more particularly to such an assembly utilizing an opaque alphanumeric indicia arranged on a translucent back-lighted panel. The improvement further consists of the utilization of a substantially continuous string array of closely spaced apart light sources of modest intensity, with the continuous array of light sources being arranged substantially continuously within an opaque frame box structure which supports the translucent back-lit panel.

In residential dwellings, it is a requirement that each such dwelling carry visible alphanumeric indicia identifying the correct address of the structure. In many instances, the requirement is satisfied by posting a series of numerals or alphabetical characters on the exterior surface of the structure. While such an arrangement is satisfactory for identification during the daylight hours, it frequently is helpful to have a means of illuminating the characters to assist those who may be desirous of locating a particular dwelling or establishment.

While exterior lighting posted adjacent the alphanumeric indicia may be useful, it is frequently desirable to have a more decorative appearance for such indicia, and in those instances, a translucent back-lighted panel has sometimes been utilized. In order to provide a proper balance between light sources providing the energy in the panel per se, conventional incandescent lighting has been proposed and utilized. One of the problems encountered with conventional incandescent lighting is the relatively uneven intensity with which the light source reaches the back-lighted panel. In many instances, there are areas which are relatively intensely lit, while other areas may be only relatively dimly lit. This difference in light intensity for the panel tends to detract from the overall appearance of the arrangement and as such has been generally undesirable.

One of the solution to the uneven characteristics is to employ a translucent panel with relatively poor light transmission characteristics. Such an arrangement, however, presents additional problems in that the light intensity required for the incandescent sources may dissipate sufficient power so as to create a heat problem. Thus, the typical solution to creating a back-lit panel with illuminated hot spots lies at cross-purposes to a reasonable and desired solution.

SUMMARY OF THE INVENTION

In accordance with the present invention, however, an illuminated sign assembly is provided with an opaque indicia arranged on a translucent back-lighted panel, and a lighting source is provided which provides an even distribution of light across the surface of the translucent panel so as to provide a pleasing appearance to the panel when lit. In this connection, an opaque frame means is provided with the frame consisting of an elongated rectangular enclosure with four walls, a bottom wall and an open top. The top comprises a translucent back-lighted panel with a configuration matching that of the bottom surface and thereby completing the enclosure. Illuminating means are provided within the enclosure, with the illuminating means comprising a substantially continuous string or array of closely spaced apart light sources, with each light source having modest power requirements and dissipating between about 3 and 4 watts of electrical energy. Also, these light sources are arranged in a typical rope light arrangement with approximately one-inch center-to-center bulb spacing. The opaque alphanumeric characters are provided on an indicia plate which is superimposed upon the translucent panel representing the address of the specific structure, with the frame walls having a height dimension such that the light sources are separated from the translucent back panel by a distance which substantially equals the spacing between a pair of mutually adjacent light sources.

Therefore, it is a primary object of the present invention to provide an improved illuminated sign assembly having opaque indicia arranged on a translucent back-lighted panel, wherein the light source for the panel comprises a substantially continuous string array of closely spaced apart light sources.

It is yet a further object of the present invention to provide such an illuminated sign assembly which includes an elongated rectangular enclosure with four walls, a bottom and an open top for receiving the translucent back-lighted panel, and wherein a substantially continuous string array of closely spaced apart light sources are disposed beneath an inwardly extending opaque flange so as to more evenly distribute the light energy across the visible or non-obscured portion of the panel.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
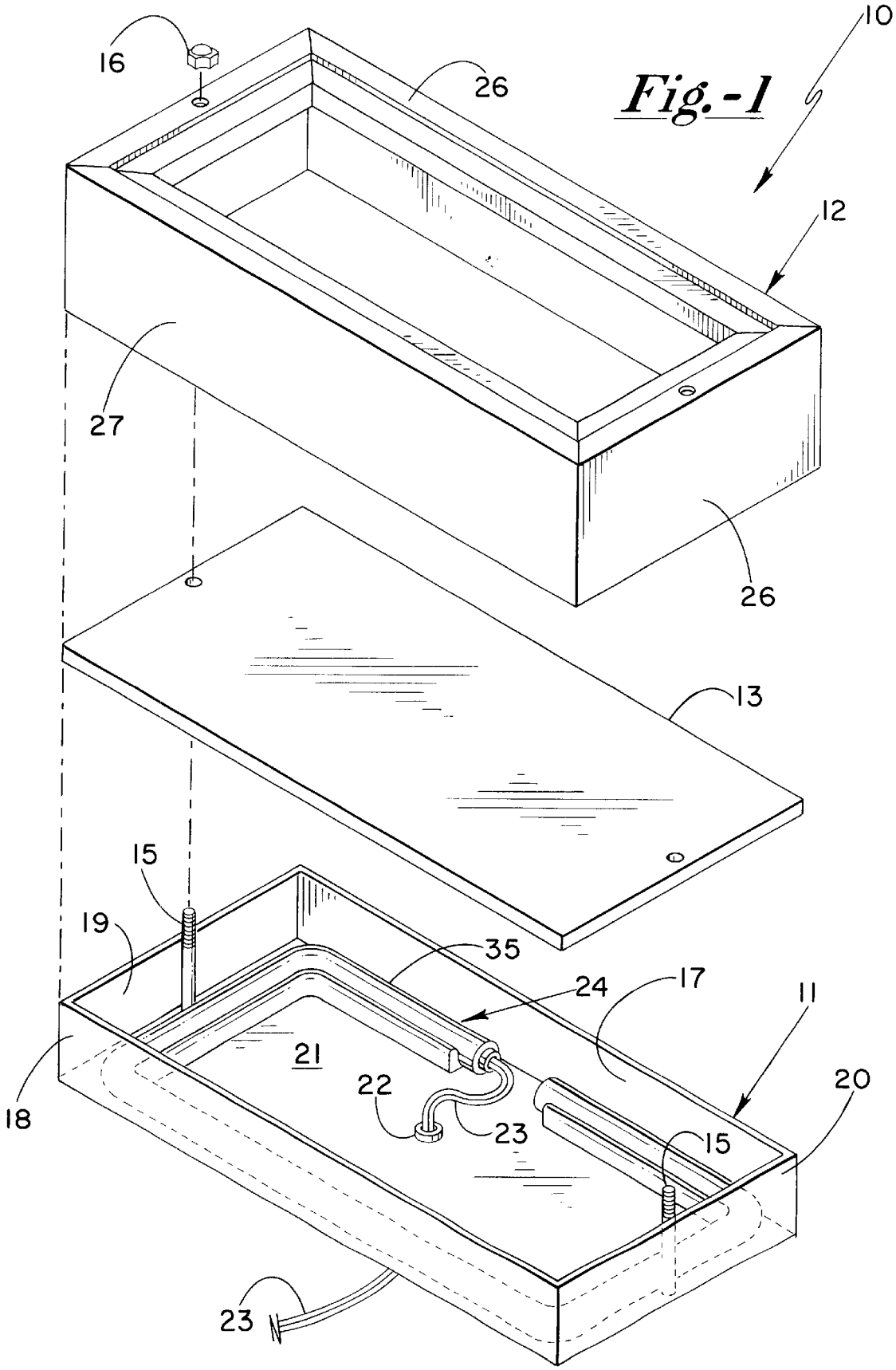
FIG. 1 is an exploded perspective view of the illuminated sign assembly of the present invention, with the view illustrating the configuration of the base, cover, and intervening translucent panel.

With particular attention being directed to FIG. 1 of the drawings, it will be noted that the illuminated sign assembly generally designated 10 includes an elongated rectangular enclosure 11 consisting of walls 17, 18, 19 and 20 which form a base housing or enclosure. Bottom surface 21 is provided having a configuration and means for receiving threaded rods or clamping bolts 15—15 thereon. Clamp pan or cover retainer member generally designated 12 is in the form of a pan which receives and supports translucent panel 13, with panel 13 being designed to be received along the upper edge surfaces of walls 17, 18, 19 and 20. Clamping nuts as at 16—16 are designed to threadedly engage threaded rods, 15 so as to clamp pan member 12 in place.

With continued attention being directed to FIG. 1, the base 11 is utilized to house and secure the illuminating means therewithin. In this connection, grommet 22 is placed within a bore formed in bottom 21 of base 11 for passage of power cord 23 therethrough. Power cord 23 is utilized to deliver power to the substantially continuous string array of closely spaced apart light sources in the rope lighting member 24. In this connection, the rope lighting array 24 utilizes individual closely spaced apart light sources each having a power dissipation of between about 3 and 4 watts. These individual light sources are spaced on one-inch centers throughout the length of member 24. Member 24 consists of a substantially transparent outer sleeve into which is received the inner sleeve of the individual light sources. Rope lights of this type are commercially available.

Figure 6:
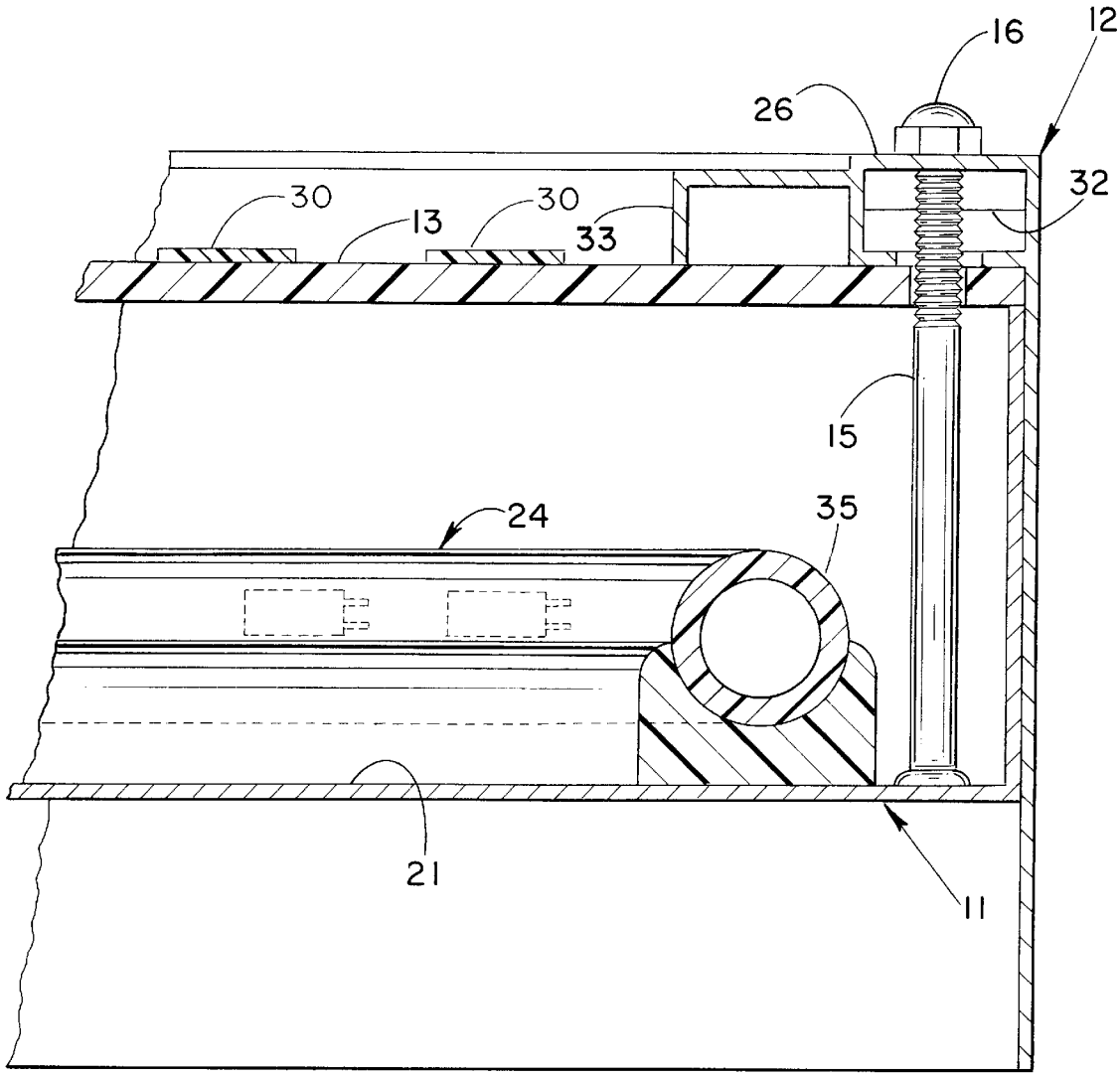
FIG. 6 is a fragmentary vertical sectional view taken along the line and in the direction of the arrows 6—6 of FIG. 2.

Upon further review of the base arrangement as illustrated in FIG. 1, the outer sleeve or outer peripheral member 35 of the light string is received in a receiving cradle as illustrated in FIG. 6. Also, with continued attention directed to FIG. 6, the individual light sources are illustrated as confined within the outer sleeve 35 of light string 24.

Figure 2:
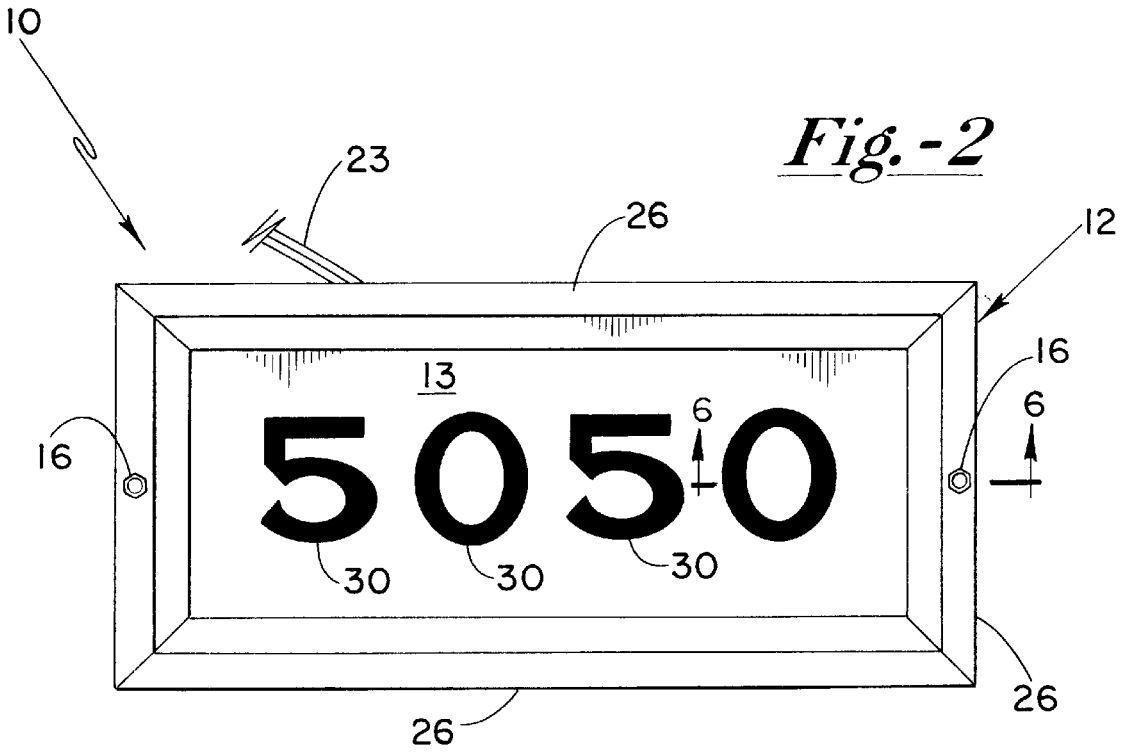
FIG. 2 is a top plan view of the illuminated sign assembly and illustrating a typical array of numerical characters superimposed upon the translucent panel.
Figure 3:
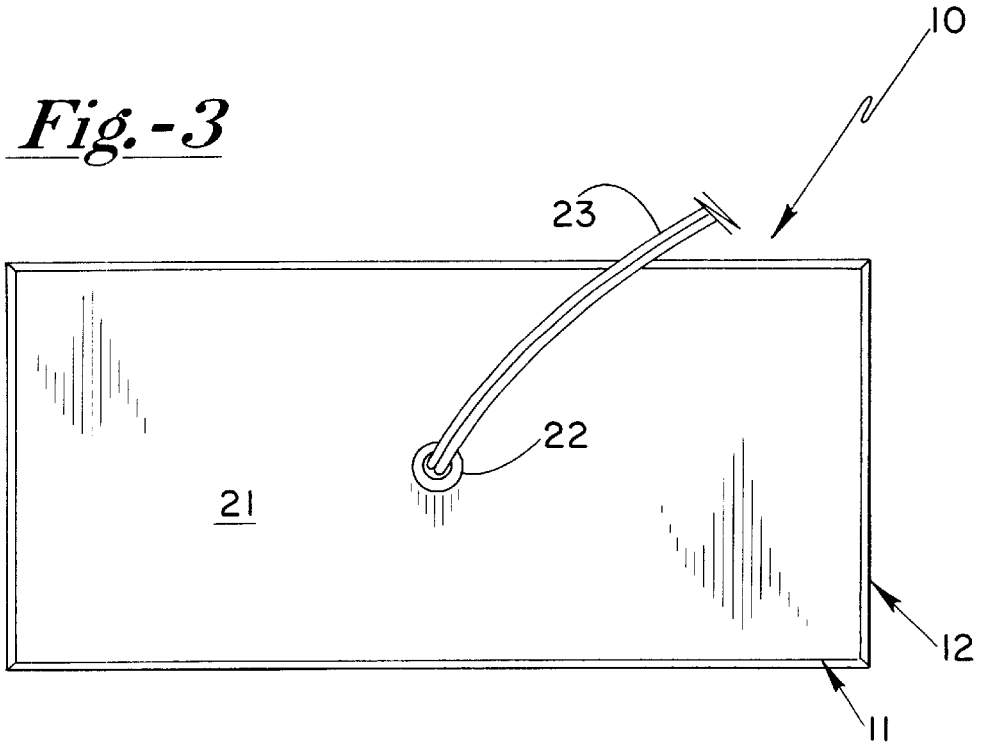
FIG. 3 is a bottom plan view of the assembly.

With attention now being directed to FIG. 2 of the drawings, it will be noted that translucent panel 13 has arranged on the upper surface thereof a plurality of opaque alphanumeric characters 30—30, and in this arrangement, the alphanumeric characters are indicia representative of the address of the structure for which the arrangement is intended. Characters 30—30 are shown arranged on the surface of translucent panel 13.

Figure 4:
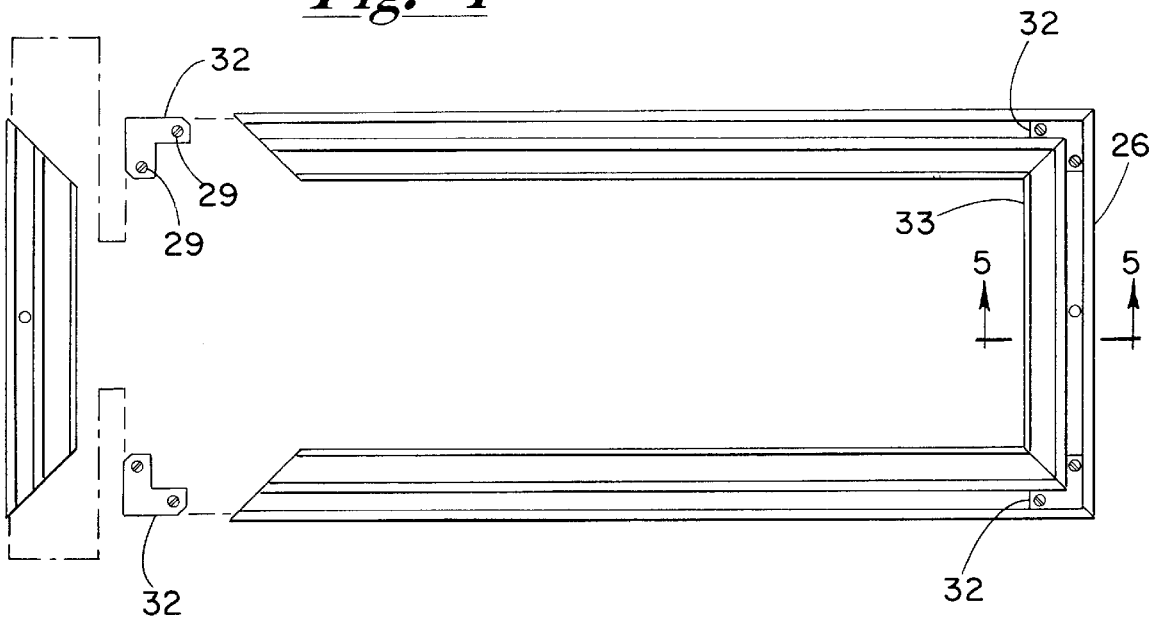
FIG. 4 is a bottom plan view of the frame structure comprising the pan component of the enclosure, and illustrating the arrangement and disposition of corner brackets utilized to support the individual lighted edge pieces.
Figure 5:
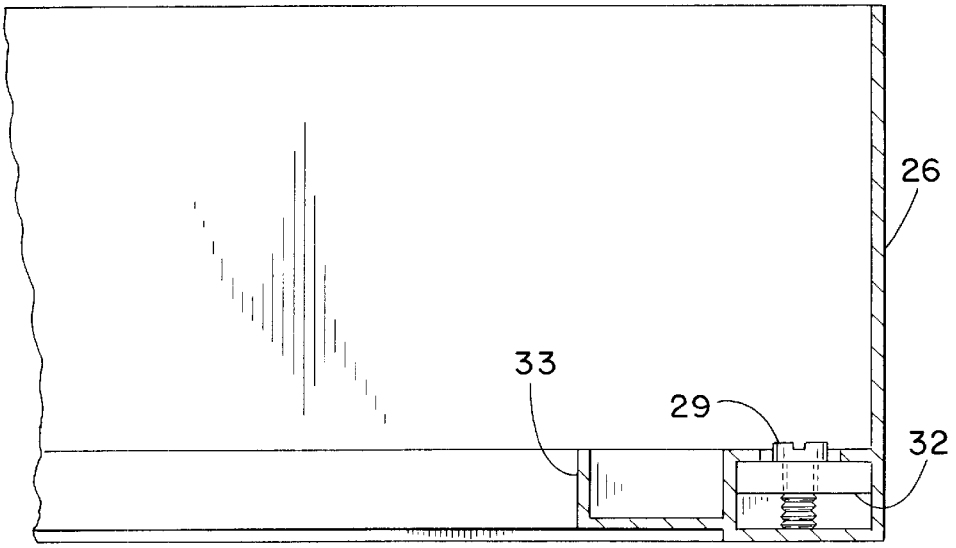
FIG. 5 is a sectional view on a slightly enlarged scale taken along the line and in the direction of the arrows 5—5 of FIG. 4, and with the view showing the cover member in inverted configuration with the corner attachments being shown.

Cover pan 12 consists of a series of coupled rectangular extrusion moldings 26—26 for example, with these moldings being held together by corner brackets such as corner brackets 32—32 (FIG. 4). At the inner edge of extrusion molding 26, an inwardly extending flange-like member 33 is placed and is designed to make contact with the exposed outer surface of translucent panel 13, and thereby obscure the individual light sources from directly illuminating the undersurface of panel 13. In this fashion, the individual sources of light energy provide a more even and uniform distribution so as to avoid the appearance of individual "hot spots". A number of screws such as corner screws 29 are utilized to retain integrity between the individual mated extrusion moldings 26—26.

Accordingly, the configuration of the continuous array of closely spaced apart light sources provides an overall lighting effect which is substantially uniform across the surface of the translucent back-lighted panel. Furthermore, the power consumption is sufficiently low so that special heat dissipating openings and/or channels are not required. The utilization of the tight enclosure provides limited access toward insects which may otherwise enter the enclosure so as to render frequently disassembly and cleaning a necessity. Furthermore, the spacing between the bottom of the enclosure and the translucent panel is such that the heat dissipation requirements are met when the spacing is about two times the spacing between mutually adjacent light sources. In this case, with light sources spaced apart at one-inch intervals, the spacing between the bottom surface and the translucent panel is preferably about one inch.

It will be appreciated that the description herein is exemplary only and is given for purposes of better assisting those of skill in the art to comprehend the invention.

What is claimed is:

1. In an illuminated sign assembly having opaque indicia arranged on a translucent back-lighted cover panel, said illuminated sign assembly comprising:

(a) an opaque frame means consisting of an elongated rectangular enclosure with four walls, a bottom wall enclosure and an open top;

(b) a top surface comprising said translucent back-lighted cover panel with a configuration and dimensions at least as great as those of said bottom surface to fully complete said enclosure;

(c) illuminating means comprising a substantially continuous string array of closely spaced apart discrete light sources of a rope lighting with each light source dissipating between 3 and 4 watts of electrical energy;

(d) an opaque indicia plate consisting of characters representing a street address superimposed upon the outer surface of said translucent panel; and (e) said opaque frame means including an inwardly between extending flange disposed in vertically spaced relationship said string array of closely spaced apart light sources and said translucent back lighted cover panel such that the light sources cast light indirectly upon and illuminate said translucent cover panel.

2. The illuminated sign assembly of claim 1 wherein said spaced apart discrete light sources are disposed at approximately one inch centers throughout said array.

* * * * *

UNITED STATES PATENT AND TRADEMARK OFFICE

CERTIFICATE OF CORRECTION

PATENT NO. : 6,557,283 B1
DATED : May 6, 2003
INVENTOR(S) : Mark Canfield

It is certified that error appears in the above-identified patent and that said Letters Patent is hereby corrected as shown below:

Column 4,
Line 38, delete “between” before “extending”.
Line 39, after “relationship” insert -- between --.

Signed and Sealed this

Second Day of September, 2003

JAMES E. ROGAN
*Director of the United States Patent and Trademark Office*